US009081322B2

(12) United States Patent
Herloski et al.

(10) Patent No.: US 9,081,322 B2
(45) Date of Patent: Jul. 14, 2015

(54) LED PRINTHEAD WITH RELAY LENS TO INCREASE DEPTH OF FOCUS

(71) Applicant: Xerox Corporation, Norwalk, CT (US)

(72) Inventors: Robert P. Herloski, Webster, NY (US); Paul A. Hosier, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 14 days.

(21) Appl. No.: 14/106,937

(22) Filed: Dec. 16, 2013

(65) Prior Publication Data

US 2015/0168864 A1 Jun. 18, 2015

(51) Int. Cl.
*B41J 2/435* (2006.01)
*G03G 15/04* (2006.01)

(52) U.S. Cl.
CPC ..... *G03G 15/04054* (2013.01)

(58) Field of Classification Search
CPC ..... G01T 1/2014; B41J 2/451; B41J 2/45; G03G 15/04054
USPC ..... 347/224, 244; 385/116, 120; 356/402
See application file for complete search history.

(56) References Cited

U.S. PATENT DOCUMENTS 3,658,407 A * 4/1972 Kitano et al. ..... 385/116
5,166,999 A * 11/1992 Rees et al. ..... 385/120
6,384,918 B1 * 5/2002 Hubble et al. ..... 356/402
8,120,635 B2 * 2/2012 Koizumi et al. ..... 347/244

OTHER PUBLICATIONS

"Amorphous Silicon (a-Si) Photoreceptor Drums", Kyocera Corporation, http://global.kyocera.com/prdct/printing-devices/electrophotography/index.html, retrieved from the Internet Nov. 25, 2013, 3 pgs.
"Printing Devices", General Brochure, Kyocera Corporation, Jul. 2013, pp. 1-16.

* cited by examiner

*Primary Examiner* — Julian Huffman
*Assistant Examiner* — Carlos A Martinez
(74) *Attorney, Agent, or Firm* — Fay Sharpe LLP

(57) ABSTRACT

LED printhead apparatus and printing systems are presented in which an LED array and a first high angle lens array are housed in an LED printbar assembly and a second low angle lens array is provided between the first lens array and a photoreceptor belt or drum in order to relay the output of the first lens array to the photoreceptor to provide a larger depth of focus and to reduce waterfront and tolerance issues near the photoreceptor.

20 Claims, 4 Drawing Sheets

LED PRINTHEAD WITH RELAY LENS TO INCREASE DEPTH OF FOCUS

BACKGROUND

The present exemplary embodiments relate to printing systems and to techniques and apparatus for increasing depth of focus of an LED printhead. LED arrays and other light sources are commonly used for selective exposure of a photoreceptor belt or drum in xerographic printing systems. Raster Output Scanning (ROS) exposure systems involve rotating polygon mirror assemblies to scan the light output in a cross-process or fast scan direction through an optical system onto the photoreceptor moving along a process direction. ROS systems advantageously use a small number of light sources to scan across the cross-process direction of the photoreceptor, thereby creating images with potentially high dots per inch count, but occupy a large amount of physical space including a fairly large amount of process-direction area proximate the photoreceptor, sometimes referred to as waterfront. Many printing systems employ more than one xerographic imaging station, with a photoreceptor traveling along a path past the imaging stations for sequential transfer of different toner colors, such as cyan (c), magenta (m), yellow (y) and black (k) to build a color image on the photoreceptor prior to image transfer to a printed medium, such as a sheet of paper, after which the transferred image is thermally fused in a fusing station. In certain applications, moreover, it is desirable to provide a further imaging station along the path of the photoreceptor, for example, to add a further color for gamut extension and/or for providing a specific customer-requested Pantone color or for other special-purpose printing capabilities. However, many printing system designs do not accommodate the addition of a fifth ROS type imaging station, largely due to the total space and waterfront considerations. LED printheads may be used in such situations, as they occupy less physical space than ROS type systems. LED printhead assemblies for printbars typically include an LED array with a large number of LEDs corresponding to or exceeding the desired pixel resolution across the cross-process direction, along with a focusing lens. The use of such a print bar to provide a fifth imaging station in a conventional CMYK printing system, however, requires careful tailoring of the focal distance or depth of focus of the focusing lens of the print bar. Accordingly, improved LED printhead apparatus and printing systems are desirable to provide a tailored depth of focus while reducing waterfront and tolerance issues near the photoreceptor.

BRIEF DESCRIPTION

The present disclosure relates to LED printhead apparatus and printing systems including an LED array and two lens arrays, such as self-focusing lens arrays to provide a compact, low waterfront imaging apparatus which can be tailored to a variety of different applications by changing the angle or depth of focus of the second lens array. A first high angle lens array can be provided in an LED printbar assembly with the LED array, and a second low angle lens array is provided between the first lens array and a photoreceptor, such as a belt or drum, to relay the output of the first lens array to the photoreceptor, thereby providing a larger depth of focus and reducing waterfront and mitigating tolerance issues near the photoreceptor.

Printing systems and printhead apparatus therefor are disclosed, which include an LED array with a plurality of LEDs, and a first self-focusing lens array with multiple lens elements. A second self-focusing lens array is provided, and is disposed between the first lens array and a photoreceptor in use in a given application. In certain embodiments, the first and second lens arrays are spaced from one another by a distance approximately equal to the sum of the image conjugate distance of the first lens array and the object conjugate distance of the second lens array along a first direction between the LED array and the photoreceptor location. In certain embodiments, moreover, the depth of focus of the second lens array is greater than that of the first lens array, and the second lens array is spaced along the first direction from the photoreceptor by a distance approximately equal to the image conjugate distance of the second lens array. In certain implementations, moreover, the LED array and the first lens array are housed in an LED printbar assembly, and the width of the second lens array in a direction parallel to the photoreceptor path direction is less than the corresponding width of the LED printbar assembly, thereby reducing the overall waterfront area occupied by the printhead apparatus near the photoreceptor. One or both of the lens arrays may include gradient index lens elements in certain embodiments. Furthermore, the first lens array in certain embodiments has a first angle and the second lens array has a lower angle, thereby providing a larger depth of focus and corresponding larger spacing distance between the second lens array and the photoreceptor. The various concepts of the present disclosure thus advantageously facilitate use of the second lens array as a relay lens without modification of the depth of focus of the first lens array, and different relay lenses can be employed in different printing systems to accommodate any desired depth of focus and lens/photoreceptor spacing.

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter.

DETAILED DESCRIPTION

Figure 1:
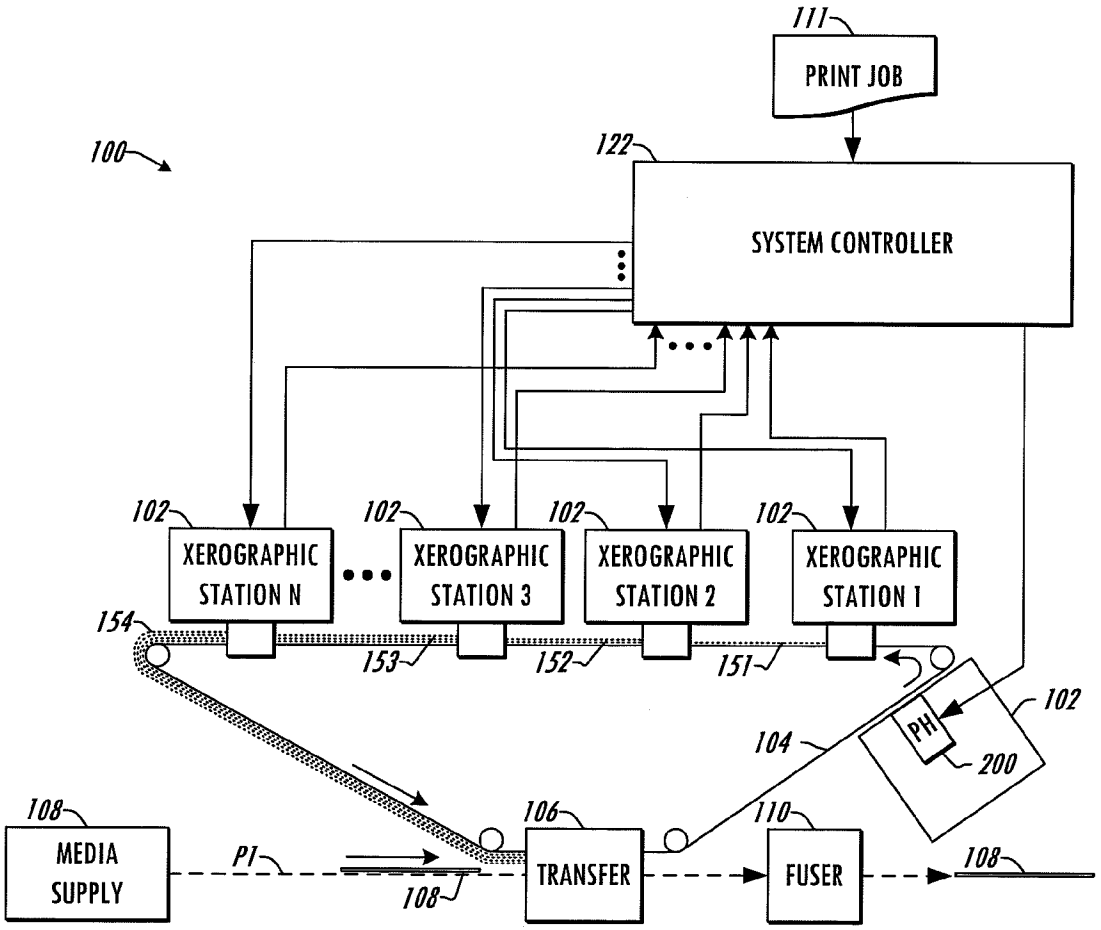
FIG. 1 is a simplified schematic system level diagram illustrating an exemplary multi-color document processing system with multiple marking devices including an additional marking station having an LED print block or printhead assembly in accordance with various aspects of the present disclosure.

Several embodiments or implementations of the different aspects of the present disclosure are hereinafter described in conjunction with the drawings, wherein like reference numerals are used to refer to like elements throughout, and wherein the various features, structures, and graphical renderings are not necessarily drawn to scale. The disclosure relates to apparatus and techniques for enhancing the depth of focus of an LED printbar assembly using a relay lens array, and will be described in the context of a multi-color printing system having multiple ROS-based primary imaging stations or print engines, although the printhead apparatus of the present disclosure finds utility in other printing and imaging applications.

FIG. 1 illustrates an exemplary tandem multi-color document processing system 100 with a system controller 122. A primary set of ROS-based marking devices or print engines 102 individually include a raster output scanner (ROS, not shown) and the marking devices individually provide toner marking material onto an intermediate photoreceptor substrate 104, in this case, a shared intermediate transfer belt 104 (ITB) traveling in a counter clockwise direction in the figure past the marking devices 102. The marking devices 102 in the exemplary system 100 individually provide marking of a distinct color (e.g., CMYK) according to color-specific image data from the system controller 122. The various concepts of the present disclosure provide printhead apparatus which may be used for imaging by directing light toward a photoreceptor, and can be employed within a given xerographic marking station for imaging of a cylindrical drum photoreceptor (not shown) from which toner is provided to an intermediate transfer substrate such as the intermediate transfer belt 104 before final image transfer to a final printable media 108, such as cut sheet paper. In the illustrated implementations, moreover, the marking stations 102 are constructed so as to implement imaging operations and to provide toner directly to the photoreceptor belt 104 with the toner from the belt 104 being then transferred to cut sheet paper media 108. The printhead apparatus and techniques of the present disclosure can be employed in a single marking station or in a given marking station of a printing system having multiple marking stations. Moreover, the present disclosure finds utility for imaging operations associated with a marking station, whether the marking station images a belt or drum type photoreceptor for direct transfer of a toner image to a printable media, or whether the marking station images a photoreceptor from which a toner image is first transferred to an intermediate transfer belt or other intermediate medium, and from which a final toner image is transferred from the intermediate medium to cut sheet paper or other final print media.

In addition, as described further below, an additional marking station 102 is provided having an LED printhead apparatus 200 upstream of the remaining marking devices 102 along the path of the ITB photoreceptor 104 using an LED array and two or more lens arrays without a ROS (e.g., non-scanning). In other possible implementations, the additional marking station 102 may be provided downstream of the other marking devices 102 along the photoreceptor path. A transfer station 106 is situated downstream of the marking devices 200, 102 along a lower portion of the ITB path to transfer marking material from the ITB 104 to an upper side of a final print medium 108 traveling along a path P1 from a media supply. After transfer of toner to the print medium 108 at the transfer station 106, the final print medium 108 is provided to a fuser type affixing apparatus 110 along the path P1 where the transferred marking material is thermally fused to the print medium 108.

As further shown in FIG. 1, the system controller 122 performs various control functions and may implement digital front end (DFE) functionality for the system 100. The controller 122 may be any suitable form of hardware, processor-executed software and/or firmware, programmable logic, or combinations thereof, whether unitary or implemented in distributed fashion in a plurality of processing components. In a normal printing mode, the controller 122 receives incoming print jobs 118 and operates one or more of the marking devices 102, 200 to transfer marking material onto the ITB 104 in accordance with image data of the print job 118. Marking material (e.g., toner 151 for the first device 102 in FIG. 2) is supplied in certain possible embodiments to an internal drum photoreceptor (not shown) via a ROS of the marking device 102. A surface of the intermediate medium 104 is adjacent to and/or in contact with the drum photoreceptor and the toner 151 is transferred to the ITB 104 with the assistance of a biased transfer roller (not shown) to attract oppositely charged toner 151 from the drum onto the ITB surface as the ITB 104 passes through a nip between the drum and a biased transfer roller. The toner 151 ideally remains on the surface of the ITB 104 after it passes through the nip for subsequent transfer and fusing to the final print media 108 via the transfer device 106 and fuser 110.

In the multi-color example of FIG. 1, each xerographic marking device 102 is operable under control of the controller 122 to sequentially transfer toner 151-154 of a corresponding color (e.g., cyan (c), magenta (m), yellow (y), black (k)) to the transfer belt 104. In addition, the non-ROS marking station with an LED printhead apparatus 200 in this example is also operated under control of the controller 122. In normal operation, print jobs 118 are received at the controller 122 via an internal source such as a scanner (not shown) and/or from an external source, such as one or more computers connected to the system 100 via one or more networks, or from wireless sources. The system 100 can include one or more sensors internal to the marking stations 102 and/or external thereto, for instance, to measure one or more marking material transfer characteristics relative to the intermediate transfer belt 104 or other photoreceptor or with respect to a final printed medium 108, and corresponding feedback signals or values are provided to the controller 122.

Figure 2:
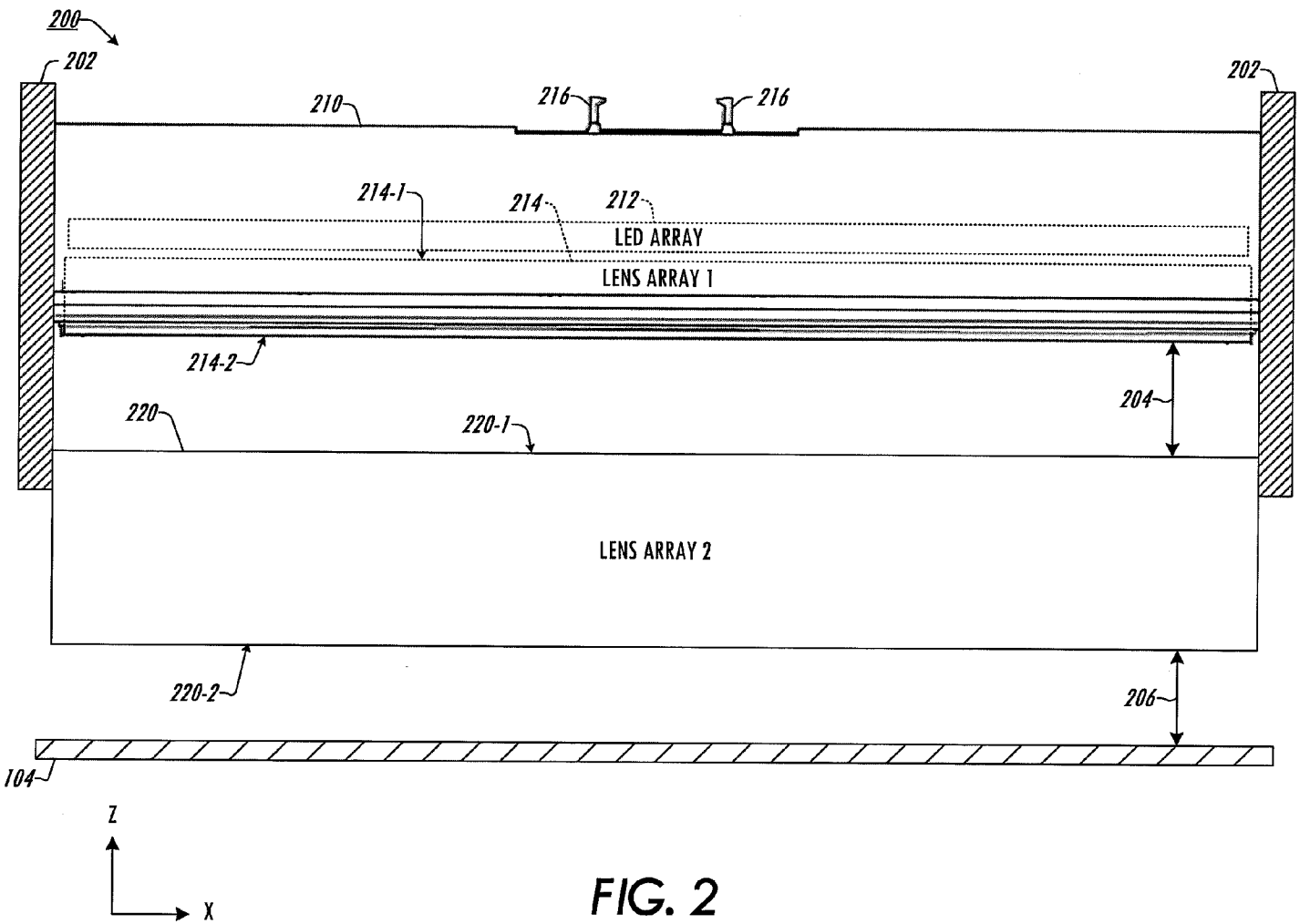
FIG. 2 is a front elevation view of the LED printhead assembly including an LED array as well as first and second lens arrays in accordance with the present disclosure.
Figure 3:
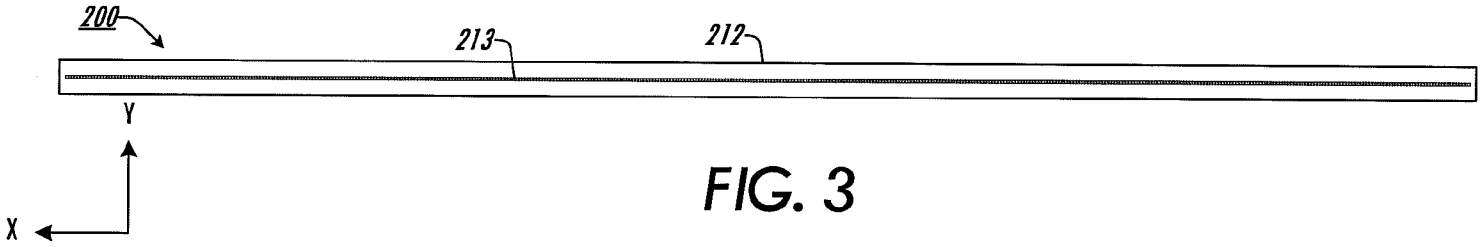
FIG. 3 is a bottom plan view illustrating the LED array of the LED printhead assembly.

Referring also to FIGS. 2-7, an example of the non-ROS printhead apparatus 200 is shown in FIG. 2, disposed so as to image select portions of the ITB photoreceptor 104 using light emitted by an LED array 212 in a downward optical path direction (in the negative "Z" direction in the figures). Other elements of the marking station employing the printhead 200 (e.g., marking material transfer components, etc.) are omitted so as not to obscure the various aspects of the present disclosure. Although illustrated and described in the context of imaging on the belt-type photoreceptor 104, the printhead apparatus 200 of the present disclosure may be used inside a marking station for imaging of a drum type photoreceptor, or in any other situation in which imaging is to be performed by directing light toward a photoreceptor of any suitable form. As seen in FIG. 3, the LED array 212 includes a single row of individual LEDs 213 facing outward (out of the page in FIG. 3) which are selectively actuated according to print or image data provided by the controller 122 in FIG. 1. Any suitable number of individual LEDs 213 may be provided in the array 212, for example, at least equal to a desired number of pixels for imaging along the cross-process direction of the ITB 104 (the "X" direction in the figures).

Figure 4:
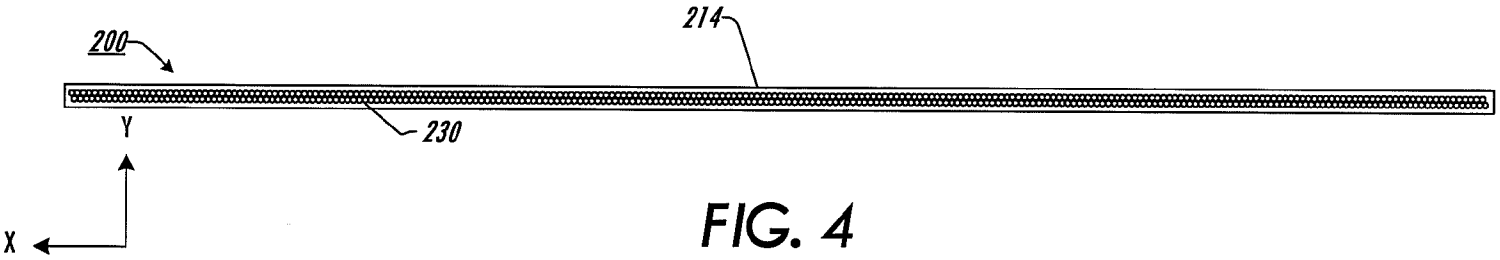
FIG. 4 is a bottom plan view illustrating the first lens array of the LED printhead assembly.
Figure 5:
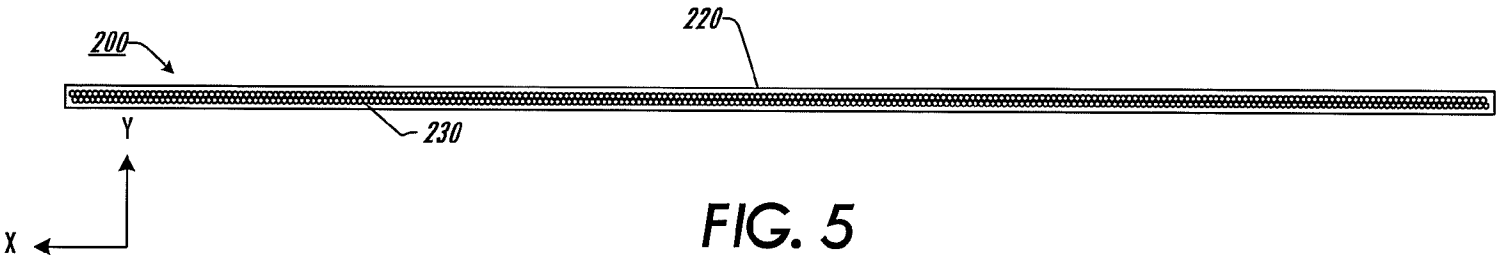
FIG. 5 is a bottom plan view illustrating the second lens array of the LED printhead assembly.

As further seen in FIGS. 2, 4 and 5, the apparatus 200 includes first and second lens arrays 214 (FIG. 4) and 220 (FIG. 5), respectively, spaced from one another along the direction of light transmission (downward in FIG. 2) by a distance 204 approximately equal to the sum of an image conjugate distance (ICD1) of the first lens array 214 and an object conjugate distance (OCD2) of the second lens array 220. In this embodiment, the LED array 212 and the lens array 214 are housed in a printbar assembly enclosure 210 providing electrical connections (not shown) at the top for connection of a control cable to provide power and image data signaling, where FIG. 2 illustrates cable clamp features 216 for secure connection of such a control cable. Within the printbar assembly 210, light is provided downward from the bottom of the LED array 212 to the top of the first lens array 214, with the enclosure 210 providing an open bottom to allow light output from the bottom of the first lens array 214 downward toward the second lens array 220. In this implementation, moreover, a fixture 202 provides structural support for the LED print bar assembly 210 (including the LED array 212 in the first lens array 214 thereof), as well as structural support for the second lens assembly 220, and provides for spacing of the output side of the LED array 212 from the input side of the lens array 214 by a distance approximately equal to the image conjugate distance (ICD1 of the first lens array 214).

The first lens array 214 is a "high angle" array, for example, having an associated half-angle of 17° in one embodiment, or 20° in another non-limiting embodiment. The half-angle of the second lens array 220, in contrast, is lower, such as about 9° in one non-limiting example. In the illustrated embodiments, the angle of the first lens array 214 is greater than about 1.8 times the lower angle of the second lens array 220, although other angle ratios may be used. The angle of the second lens array 220, moreover, is preferably significantly lower than that of the first lens array 214 such that the subsequent spacing 206 between the lower end 220-2 of the second lens array 220 and the photoreceptor 104 is approximately equal to the image conjugate distance (OCD2) of the second lens array 220. Since this lens arrays 214 and 220 provide one to one imaging, and since the image and object conjugate distances of the second lens array 220 are significantly larger than the corresponding image and object conjugate distances of the first lens array 214, use of the second lens array 220 as an optical relay to transfer light output by the first lens array 214 to the photoreceptor 104 advantageously allows a higher gap distance 206 relative to the intermediate transfer belt 104 than if the first lens array 214 were used alone. In addition, the depth of focus of the first lens array 214 is less than the depth of focus of the second lens array 220, and use of the second lens array 220 with a corresponding larger depth of focus at the output of the printhead apparatus 220 advantageously facilitates manufacturing and adjustment of the spacing distance 206 to facilitate improved focusing for imaging onto the photoreceptor 104, whereas the smaller depth of focus of the first lens array 214 would require tighter tolerances during manufacturing in positioning the apparatus 200 with respect to the photoreceptor 104.

Figure 6:
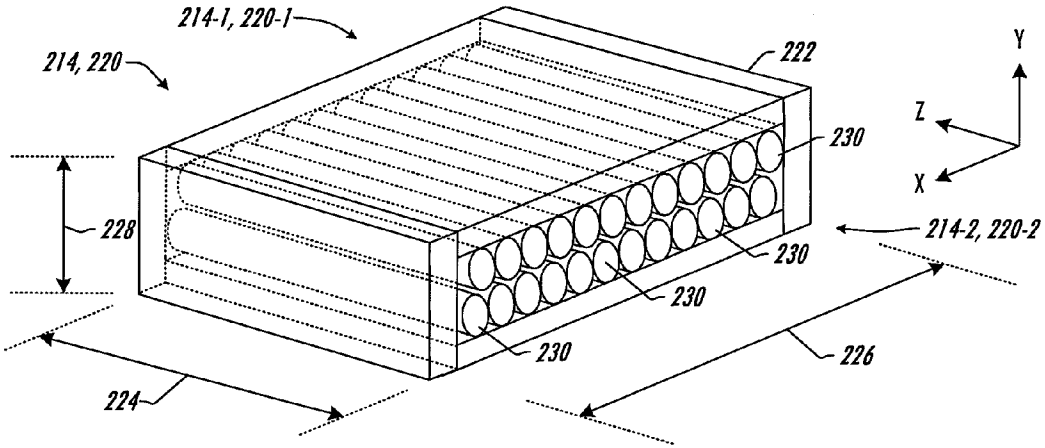
FIG. 6 is a perspective view illustrating an exemplary dual row lens array.

Referring also to FIG. 6, the lens arrays 214, 220 in certain non-limiting examples are so-called self-focusing lens arrays including two rows of lens elements 230 in this example, although a single row or several rows may be used in various alternate embodiments. The lens arrays 214, 220 in one example have similar width dimensions 228 (parallel to the Y axis in the drawing), and may have similar longitudinal cross-process direction length dimensions 226 (parallel to the X axis). In general, however, the height dimensions 224 of the first and second lens arrays 214, 220 (parallel to the Z axis, along the optical path direction in use) will generally be different, with the second lens array 220 having a larger dimension 224 compared to that of the first lens array 214. In the illustrated examples, the individual lens elements 230 are generally cylindrical extending from a first end 214-1, 220-1 to a second or exit end 214-2, 220-2 in the −Z direction in FIG. 6.

The lens elements 230, moreover, are enclosed in an enclosure 222, such as plastic in one example, having open first and second ends to allow ingress and egress of light rays via the lens elements 230. In practice, the lens arrays 214 and 220 will generally have more lens elements 230 than depicted in FIG. 6, as best shown in FIGS. 4 and 5. The elements 230 of the self-focusing lens arrays 214 and 215, in certain embodiments, are gradient index elements having indices of refraction that vary radially. These devices are commercially available, for example, from Nippon Sheet Glass Group, and are known in the art as self-focusing lenses fabricated to provide a gradual variation in the index of refraction within the lens material such that light rays are smoothly and continually redirected toward a point of focus, thereby avoiding tolerance issues associated with the shape and smoothness of conventional lens surfaces.

In operation, the gradient index elements 230 preferably employ a radial index gradient where the index of refraction is highest in the center of the generally cylindrical lens element 230 and decreases with radial distance from the center axis, wherein certain implementations provide a quadratic reduction in the index of refraction as a function of radial distance. In operation, rays entering the first end 214-1, 220-1 follow sinusoidal paths within the lens elements 230 until reaching the second ends 214-2, 220-2, and the provision of multiple lens elements 230 in the respective arrays 214, 220 effectively provides one-to-one erect imaging from input to output, where the number of lens elements 230 need not be the same as the number of LED elements in the LED array 212, and the number and arrangement of lens elements 230 in the first and second lens arrays 214 and 220 may, but need not be the same in all embodiments.

Figure 7:
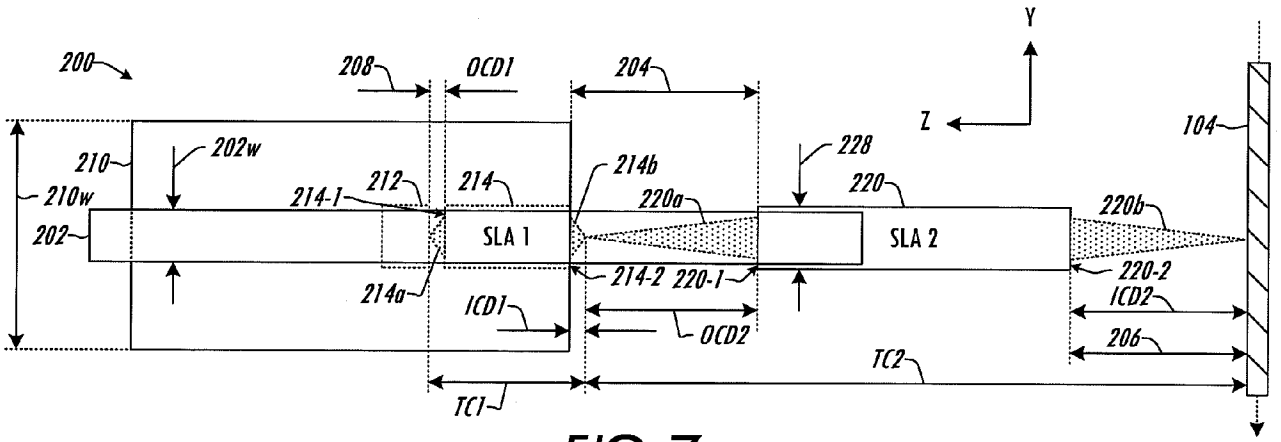
FIG. 7 is a side elevation view of the LED printhead assembly.

FIG. 7 illustrates an end view of the apparatus 200, in which light is emitted from the LED array 212 (left to right in the −Z direction in the figure) according to image data received from the system controller 122. The light from the LED array 212 is shown in dashed form 214*a* entering a first side 214-1 of the high angle first self-focusing lens array (SLA 1) 214, where the output side of the LED array 212 in this embodiment is spaced from the first side 214-1 of the first lens array 214 by the distance 208 which is preferably equal to the front focus distance or object conjugate distance for the lens array 214 (indicated as OCD1 in FIG. 7). The first lens array 214 has a second exit side 214-2 directing a second light output toward a first side 220-1 of the second (lower angle) lens array 220 at a high angle indicated as 214*b* in FIG. 7. As further shown in FIG. 7, the first lens array 214 has a relatively short total conjugate dimension TC1, whereas the second lens array 220 has a much longer total conjugate dimension TC2. As seen in FIG. 7, moreover, the first lens array 214 has a first image conjugate distance ICD1 (alternatively referred to as a back focus distance), and second lens array 220 has a second image conjugate distance ICD2 and a second object conjugate distance OCD2. In this implementation, the first side 220-1 of the second lens array 220 is spaced along the −Z direction from the second side 214-2 of the first lens array 214 by a first distance 204 approximately equal to the sum of the first image conjugate distance and the second object conjugate distance (ICD1+OCD2).

Also, the second side 220-2 of the second lens array 220 is spaced along the −Z direction from the photoreceptor 104 by a second distance 206 approximately equal to the second image conjugate distance ICD2. Furthermore, the first lens array 214 has a first depth of focus and the second lens array 220 has a second depth of focus DOF2, and wherein the first depth of focus DOF1 is less than the second depth of focus DOF2. Thus, while high angle, short depth of focus lens arrays such as the first array 214 are advantageous in certain situations requiring short optical path length, the use of the second (e.g., relay) lens array 220 advantageously increases the optical path length of the overall apparatus 200, thereby facilitating proper focusing of the incident light at the photoreceptor 104, while providing a significantly longer spacing distance 206 between the second lens array and the photoreceptor 104.

The second light output is received at the first side 220-1 of the second lens array 220, where the low angle received light entering the second lens array 220 is indicated in dashed form as 220*a*, and is only a portion of the high angle light 214*b*. The second lens array 220 provides a third light output at a second end 220-2 which faces the photoreceptor 104, illustrated in dashed form as 220*b* in the drawing. As previously mentioned, the depth of focus (DOF1) of the first lens array 214 in this example is much smaller than the depth of focus (DOF2) of the second lens array 220, and the spacing distance 204 between the second end 214-2 of the first lens array 214 and the first end 220-1 of the second lens array 220 is approximately the sum of the first image conjugate distance and the second object conjugate distance (e.g., distance 204 in FIG. 7 is approximately ICD1+OCD2), and the spacing distance 206 between the second end 220-2 of the second lens array 220 and the light-receiving surface of the photoreceptor 104 is approximately equal to the image conjugate distance ICD2 of the second lens array 220. Moreover, the second depth of focus in the illustrated example is much greater than the first depth of focus, and accordingly, the use of the relay lens array 220 allows fixturing and mounting of the apparatus 200 at a larger spacing distance 206 than would otherwise be possible using just the printbar assembly 210 and a single high angle lens array 214 without sacrificing focus and hence imaging quality in the light received at the surface of the photoreceptor 104.

As previously mentioned, provision of the relay lens array 220 between the first lens array 214 and the photoreceptor 104 provides advantages in increasing the spacing distance 206 from the photoreceptor 104 to the apparatus 200. In printing system applications, this increases the working distance from the lens 220 to the ITB photoreceptor 104, thereby facilitating efforts to keep the lens 220 clean, and facilitates provision of a sliding cleaner or other means for cleaning the second side 220-2 of the lens array 220 in the gap 206. Furthermore, the increase in the spacing distance 206 advantageously saves the cost of mechanical machining or manual or automatic focus adjustment in assembling a printing system or other host system (e.g., printing system 100 in FIG. 1 above).

In addition, use of the relay lens array 220 provides for reduction in the waterfront dimension occupied by the apparatus 200. As seen in FIGS. 6 and 7, for example, both lens arrays 214 and 220 have a lens array width dimension 228 in a direction parallel to the path direction of the photoreceptor 104 (e.g., the Y direction in the drawings) which is significantly less than the width dimension 210*w* of the LED printbar assembly housing 210. Thus, the wider printbar enclosure 210 can be spaced farther from the photoreceptor 104 due to the use of the relay lens array 220 than would otherwise be possible, whereby the waterfront distance occupied by the exemplary printhead apparatus 200 is reduced to the width 228 of the second lens array 220. Furthermore, although use of a second lens array 220 may involve a trade-off between the advantageous increase in depth of focus and a potential loss in transmitted optical power, certain applications (e.g., such as providing an additional print station in the system 100 of FIG. 1 above) may not require high lumen transfer efficiency, and the use of a second relay lens array 220 facilitates the above advantages, and further allows usage of a common printhead assembly 210 having a fixed depth of focus first lens array 214 in a variety of different system applications, wherein a different relay lens array 220 can be selected for a given application in combination with a "fixed DOF" LED array/first lens array combination 212, 214.

The above examples are merely illustrative of several possible embodiments of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several embodiments, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising". It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A printhead apparatus for generating an image on a portion of a photoreceptor traveling along a path in a path direction in a host printing system, the printhead apparatus comprising:

an LED array comprising a plurality of LEDs individually operative according to received image data to produce light output along a first direction;

a first self-focusing lens array having a plurality of gradient index lens elements with varying indices of refraction along the first direction, the first self-focusing lens array having a first side facing the LED are and receiving the light output from the LED array at first ends of the gradient index lens elements, and a second side providing a second light output at second ends of the gradient index lens elements for one-to-one erect imaging of the light output from the LED array; and a second self-focusing lens array having a plurality of gradient index lens elements with varying indices of refraction along the first direction, the second self-focusing lens array having a first side facing the second side of the first self-focusing lens array and receiving the second light output from the first self-focusing lens array at first ends of the gradient index lens elements, and a second side facing the photoreceptor and providing a third light output at second ends of the gradient index lens elements for one-to-one erect imaging of the second light output from the first self-focusing lens array onto the photoreceptor of the host printing system;

wherein the first lens array has a first image conjugate distance and a first object conjugate distance, wherein the second lens array has a second image conjugate distance and a second object conjugate distance, and wherein the first side of the second lens array is spaced along the first direction from the second side of the first lens array by a first distance approximately equal to the sum of the first image conjugate distance and the second object conjugate distance.

2. The printhead apparatus of claim 1, wherein the first lens array has a first depth of focus, wherein the second lens array has a second depth of focus, and wherein the first depth of focus is less than the second depth of focus.

3. The printhead apparatus of claim 2, wherein the second side of the second lens array is spaced along the first direction from the photoreceptor by a second distance approximately equal to the second image conjugate distance.

4. The printhead apparatus of claim 3, wherein the LED array and the first lens array are housed in an LED printbar assembly having a LED printbar assembly width dimension generally parallel to the path direction of the photoreceptor, wherein the second lens array has a lens array width dimension generally parallel to the path direction, and wherein the lens array width dimension of the second lens array is less than the LED printbar assembly width dimension.

5. The printhead apparatus of claim 4, wherein the first lens array has a first angle, and the second lens array has a lower angle than the first lens array.

6. The printhead apparatus of claim 5, wherein the first angle of the first lens array is 17 degrees or 20 degrees, and wherein the lower angle of the second lens array is approximately 9 degrees.

7. The printhead apparatus of claim 1, wherein the second side of the second lens array is spaced along the first direction from the photoreceptor by a second distance approximately equal to the second image conjugate distance.

8. The printhead apparatus of claim 1, comprising a fixture providing structural support for the LED array, the first lens array, and the second lens array, the fixture having a fixture width dimension generally parallel to the path direction, wherein the second lens array has a lens array width dimension generally parallel to the path direction, and wherein the lens array width dimension of the second lens array is less than the fixture width dimension.

9. The printhead apparatus of claim 1, wherein the LED array and the first lens array are housed in an LED printbar assembly having a LED printbar assembly width dimension generally parallel to the path direction of the photoreceptor, wherein the second lens array has a lens array width dimension generally parallel to the path direction, and wherein the lens array width dimension of the second lens array is less than the LED printbar assembly width dimension.

10. The printhead apparatus of claim 9, comprising a fixture providing structural support for the LED printbar assembly and the second lens array, the fixture having a fixture width dimension generally parallel to the path direction, wherein the lens array width dimension of the second lens array is less than the fixture width dimension.

11. The printhead apparatus of claim 2, wherein the first image conjugate distance is less than the second image conjugate distance, and wherein the first object conjugate distance is less than the second object conjugate distance.

12. The printhead apparatus of claim 2, comprising a fixture providing structural support for the LED array, the first lens array, and the second lens array, the fixture having a fixture width dimension generally parallel to the path direction, wherein the second lens array has a lens array width dimension generally parallel to the path direction, and wherein the lens array width dimension of the second lens array is less than the fixture width dimension.

13. The printhead apparatus of claim 4, comprising a fixture providing structural support for the LED printbar assembly and the second lens array, the fixture having a fixture width dimension generally parallel to the path direction, wherein the lens array width dimension of the second lens array is less than the fixture width dimension.

14. The printhead apparatus of claim 5, wherein the first angle of the first lens array is greater than about 1.8 times the lower angle of the second lens array.

15. A printing system, comprising:

a photoreceptor traveling along a path in a path direction;

a printhead apparatus operative to generate an image on a portion of the photoreceptor, the printhead apparatus comprising:

an LED array comprising a plurality of LEDs individually operative according to received image data to produce light output along a first direction, a first self-focusing lens array having a plurality of gradient index lens elements with varying indices of refraction along the first direction, the first self-focusing lens array having a first side facing the LED are and receiving the light output from the LED array at first ends of the gradient index lens elements, and a second side providing a second light output at second ends of the gradient index lens elements for one-to-one erect imaging of the light output from the LED array, and a second self-focusing lens array having a plurality of gradient index lens elements with varying indices of refraction along the first direction, the second self-focusing lens array having a first side facing the second side of the first self-focusing lens array and receiving the second light output from the first self-focusing lens array at first ends of the gradient index lens elements, and a second side facing the photoreceptor and providing a third light output at second ends of the gradient index lens elements for one-to-one erect imaging of the second light output from the first self-focusing lens array onto the photoreceptor of the host printing system; and a controller operatively coupled with the printhead apparatus to provide image data to the LED array to selectively actuate one or more of the plurality of LEDs;

wherein the first lens array has a first image conjugate distance and a first object conjugate distance, wherein the second lens array has a second image conjugate distance and a second object conjugate distance, wherein the first side of the second lens array is spaced along the first direction from the second side of the first lens array by a first distance approximately equal to the sum of the first image conjugate distance and the second object conjugate distance.

16. The printing system of claim 15, wherein the second side of the second lens array is spaced along the first direction from the photoreceptor by a second distance approximately equal to the second image conjugate distance.

17. The printing system of claim 16, wherein the first lens array has a first depth of focus, wherein the second lens array has a second depth of focus, and wherein the first depth of focus is less than the second depth of focus.

18. The printing system of claim 15, comprising a fixture providing structural support for the LED array, the first lens array, and the second lens array, the fixture having a fixture width dimension generally parallel to the path direction, wherein the second lens array has a lens array width dimension generally parallel to the path direction, and wherein the lens array width dimension of the second lens array is less than the fixture width dimension.

19. The printing system of claim 18, wherein the first lens array has a first depth of focus, wherein the second lens array has a second depth of focus, and wherein the first depth of focus is less than the second depth of focus.

20. The printing system of claim 15, wherein the first lens array has a first depth of focus, wherein the second lens array has a second depth of focus, and wherein the first depth of focus is less than the second depth of focus.

* * * * *